US007334438B2

(12) United States Patent
Johansson et al.

(10) Patent No.: US 7,334,438 B2
(45) Date of Patent: Feb. 26, 2008

(54) LATCH ASSEMBLY

(75) Inventors: Torsten Johansson, Eskilstuna (SE); Claes Magnusson, Värmdö (SE)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/108,296

(22) Filed: Apr. 18, 2005

(65) Prior Publication Data

US 2005/0229657 A1 Oct. 20, 2005

Related U.S. Application Data

(60) Provisional application No. 60/562,816, filed on Apr. 16, 2004.

(51) Int. Cl.
*E05B 59/00* (2006.01)
*E05C 1/06* (2006.01)

(52) U.S. Cl. ..... 70/107; 292/36

(58) Field of Classification Search ..... 70/107, 70/108–111, 95–100; 292/44, 11, 18, 70, 292/78, 95, 116, 332, 40, 51
See application file for complete search history.

(56) References Cited

U.S. PATENT DOCUMENTS

| | | | | | |
|---|---|---|---|---|---|
| 998,642 | A * | 7/1911 | Shean | 292/36 |
| 1,247,052 | A * | 11/1917 | Wilson | 292/5 |
| 2,540,686 | A * | 2/1951 | Milburn | 292/124 |
| 2,844,020 | A * | 7/1958 | Chittum et al. | 70/97 |
| 3,175,376 | A * | 3/1965 | Cantwell | 70/131 |
| 3,532,373 | A * | 10/1970 | Poe | 292/47 |
| 3,857,594 | A | 12/1974 | Pastva, Jr. | |
| 4,643,005 | A * | 2/1987 | Logas | 70/95 |
| 5,265,920 | A * | 11/1993 | Kaup et al. | 292/40 |
| 5,495,731 | A * | 3/1996 | Riznik | 70/108 |
| 5,765,410 | A * | 6/1998 | Kwan et al. | 70/107 |
| 6,622,535 | B2 * | 9/2003 | Chiang et al. | 70/107 |
| 2002/0104339 | A1 * | 8/2002 | Saner | 70/108 |
| 2003/0160463 | A1 * | 8/2003 | Tonges | 292/336.3 |
| 2005/0092042 | A1 * | 5/2005 | Constantinou et al. | 70/107 |
| 2006/0196236 | A1 * | 9/2006 | Gruenendahl | 70/107 |

FOREIGN PATENT DOCUMENTS

| | | |
|---|---|---|
| EP | 0021820 | 6/1980 |
| EP | 0619409 | 10/1994 |
| FR | 410434 | 12/1910 |
| GB | 0495573 A | 11/1938 |
| GB | 1467539 | 3/1977 |
| GB | 2239042 A | 5/1991 |
| GB | 2391583 | 2/2004 |

* cited by examiner

*Primary Examiner*—Jennifer H. Gay
*Assistant Examiner*—Kristina R Gluchowski
(74) *Attorney, Agent, or Firm*—Paul & Paul

(57) ABSTRACT

A latch assembly having a keyless toggle lock capability and capable of being unlocked by either a low level security key or a master key. When a user rotates the front handle or rear handle the actuator of the latch assembly provides for sliding movement of a sliding element so as to provide for actuation of a latching means.

12 Claims, 15 Drawing Sheets

LATCH ASSEMBLY

BACKGROUND OF THE INVENTION

The present invention relates generally to latch assemblies.

Latch assemblies are known in the art and are provided for the latching and the opening of a member such as a door or panel.

In addition, it is oftentimes desired that the lock cylinder of latches generally have the capability of being opened with a master key in addition to a lower level security key. This is particularly true in the case of marine applications where the individual members of a crew need access to individualized areas which the captain of the vessel also needs access to. However, there may be locked areas which are only to be accessible by the captain of the ship. In such cases, the captain would need a high level security key or master key to access his areas and also the crews areas.

In many prior art lock cylinders, the door or panel in which the lock cylinder was installed needed to be as thick as a significant portion of the length of the key which is inserted into the lock cylinder. This resulted in very long lock cylinders which oftentimes would protrude from the back side of the door or panel due to the length of the lock cylinders. Accordingly, due to space limitations it is desired to have a door or closure member which can accommodate a lock cylinder which is thin or in other words where the length of the axis of the lock cylinder is as short as possible so that the lock cylinder when installed in the door does not protrude from the front or back of the door.

A need therefore exists for a lock cylinder for a latch having a master key capability which can be accommodated in doors of a thickness which prior art lock cylinders could not be accommodated in.

A need exists for a low profile ergonometric latch assembly which can be opened by rotation of a handle which has an easy to use manual lock on one side of the latch assembly and a second lock which uses a key on the other side of the latch assembly.

The present invention has been developed in view of the foregoing and to overcome the deficiencies of the prior art.

SUMMARY OF THE INVENTION

In accordance with the present invention, it is an object of the invention to provide an ergonometric latch assembly which has an easy to use manual lock on one side of the latch assembly when the slide latch assembly is installed in a door or panel and a second lock on the other side of the slide latch assembly which uses a key. The latch assembly can be actuated by rotation of a handle of the latch.

It is an object to provide an improved lock cylinder having master key capability which is readily adaptable to different thicknesses of doors or closure members.

Another object of the present invention is to provide a door lock that is easy to operate.

A further object of the invention is to provide a lock cylinder which has a very low profile or thickness and which can be used in applications where space and thickness is a limiting factor.

It is a further object of the invention to provide a lock cylinder which can be fitted with two different annular rings, one of which is designed to operate the lock cylinder with only a master key and another which is to operate the lock cylinder with either a master key or a low level security key.

It is still another object of the invention to provide a latch assembly wherein the position of the lock in either the locked or unlocked position does not impact the ability of the user to utilize either the manual key to lock and unlock the latch or the manual toggle button located on the latch.

A further object of this invention is to provide such a lock cylinder with structural components which offers ease of assembly, and reliable operations.

The objects of the present are realized in a latch assembly for fastening and unfastening a closure member to a keeper in a latched position. The latch assembly is moveable between the latched position and an open position. The latch assembly preferably comprises a latching means which preferably comprises a pawl actuator, a first rotary pawl which is rotatable, a second rotary pawl having a lever, said first rotary pawl engaging and rotating the second rotary pawl upon actuation of the lever by the pawl actuator such that said first rotary pawl and said second rotary pawl rotate into a latched position and engage the keeper. The latching means also comprises a biasing means which biases said pawl actuator to the latched position.

An actuator is provided in the slide latch assembly for displacing the pawl actuator. The actuator has a sliding element having a sliding element notch. The locking mechanism of the latch assembly has a toggle button which has a toggle button protuberance. The toggle button is capable of moving the toggle button protuberance such that the toggle button protuberance engages the sliding element notch thereby placing the latch assembly into a locked state in which movement of the sliding element is not permitted. The toggle button is also moveable into a position such that the toggle button protuberance does not engage the sliding element notch thereby placing the slide latch assembly in the unlocked state in which displacement of the sliding element is permitted.

The locking mechanism has a lock cylinder having a lock plug which rotates a locking ring having a locking ring protuberance thereby providing for selective placement of the latch assembly into the locked state or the unlocked state upon rotation of a lock plug by the engagement of the locking ring protuberance with the toggle button.

At least one handle is provided on the latch for actuating the actuator and providing a sliding motion to the sliding element such that the sliding element actuator actuates latching means. Rotation of the handle rotates a first actuator rotation means which in turn rotates a second actuator rotation means which has camlike protuberances which act upon a left sliding element prong or a right sliding element prong so as to move the sliding element such that the sliding element actuates the latching means.

The objects of the present invention are also realized in a lock cylinder configured for a key. Master key functionality is attained by adding an annular ring to the basic lock cylinder structure and modifying the profile of the low level security key. A separate key profile for each key is provided to provide the master key capability. A portion of one of the bits of the master key is machined deeper than the low level security key and has a key stop where the bit abuts the stem. When the lock cylinder is provided with a master annular ring, the lock cylinder can only be operated by the master key and not the limited access low level security key due to the presence of a tab on the master annular ring provided on the front of the lock cylinder which prevents entry of the limited access or low level security key into the lock cylinder. The master key can also operate the lock cylinder when the lock cylinder is fitted with a low level security annular ring which does not have the tab which is present on the master annular ring.

BRIEF DESCRIPTION OF THE DRAWINGS

The features, advantages and operation of the present invention will become readily apparent and further understood from a reading of the following detailed description of the invention with the accompanying drawings, in which like numerals refer to like elements, in which.

DETAILED DESCRIPTION OF THE INVENTION

Figure 16:
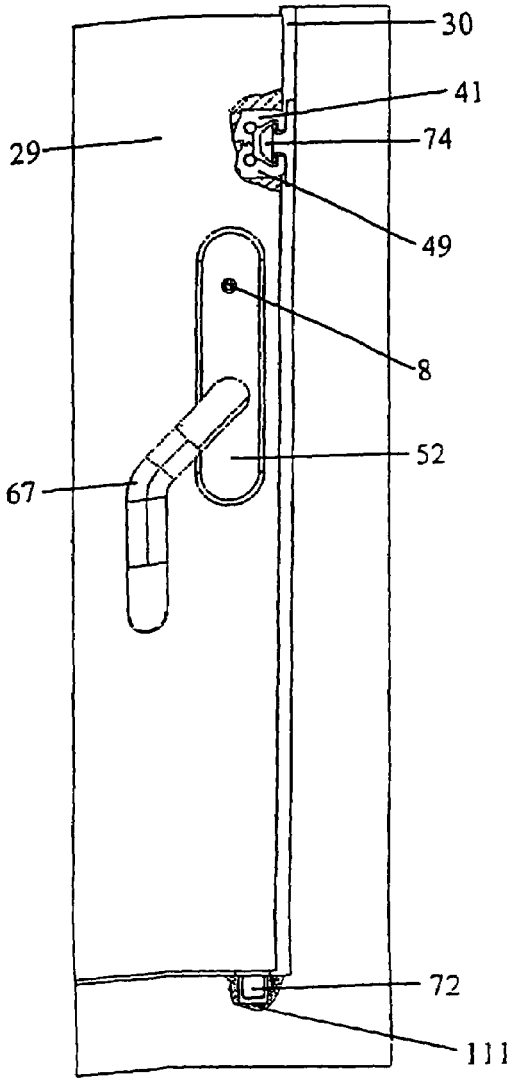
FIG. 16 is a rear view of latch assembly of the present invention installed in a door and latched to a keeper on a frame shown partially cutaway in section so as to show a plunger and the latching means.
Figure 17:
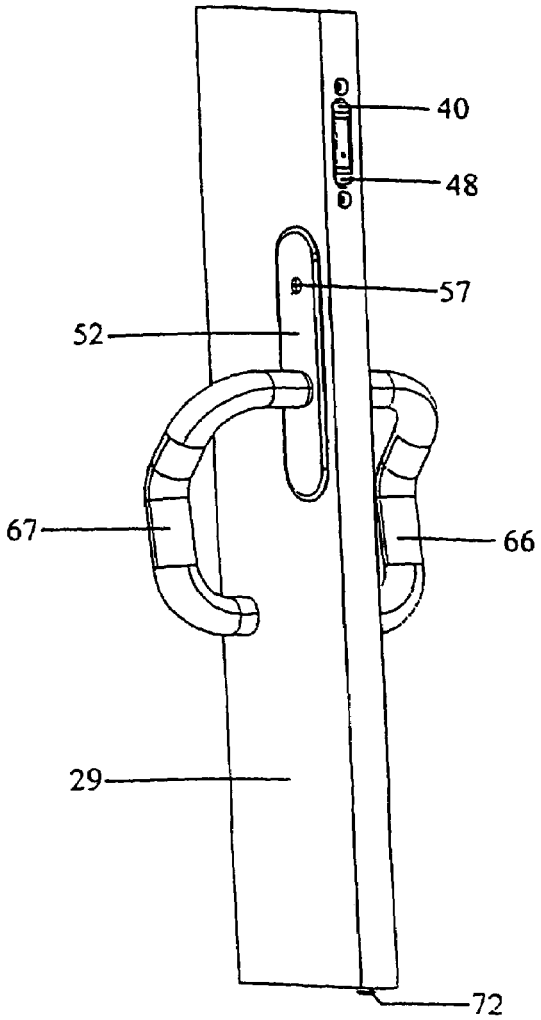
FIG. 17 is a perspective view of the rear of the latch assembly of the present invention in the open position shown installed in a door.
Figure 19:
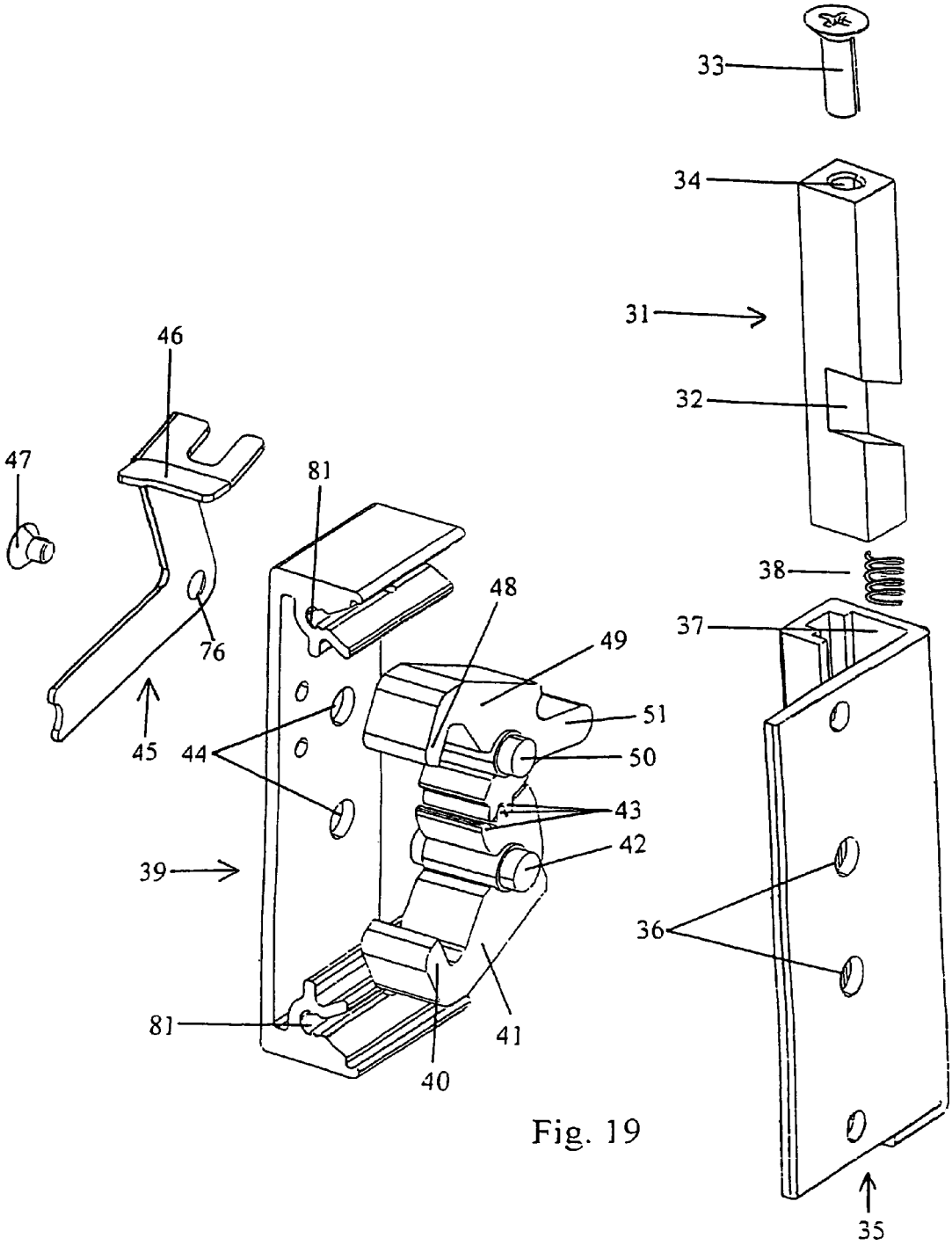
FIG. 19 is an exploded view of the latching means of a preferred embodiment of the latch assembly of the present invention in the open position.
Figure 21:
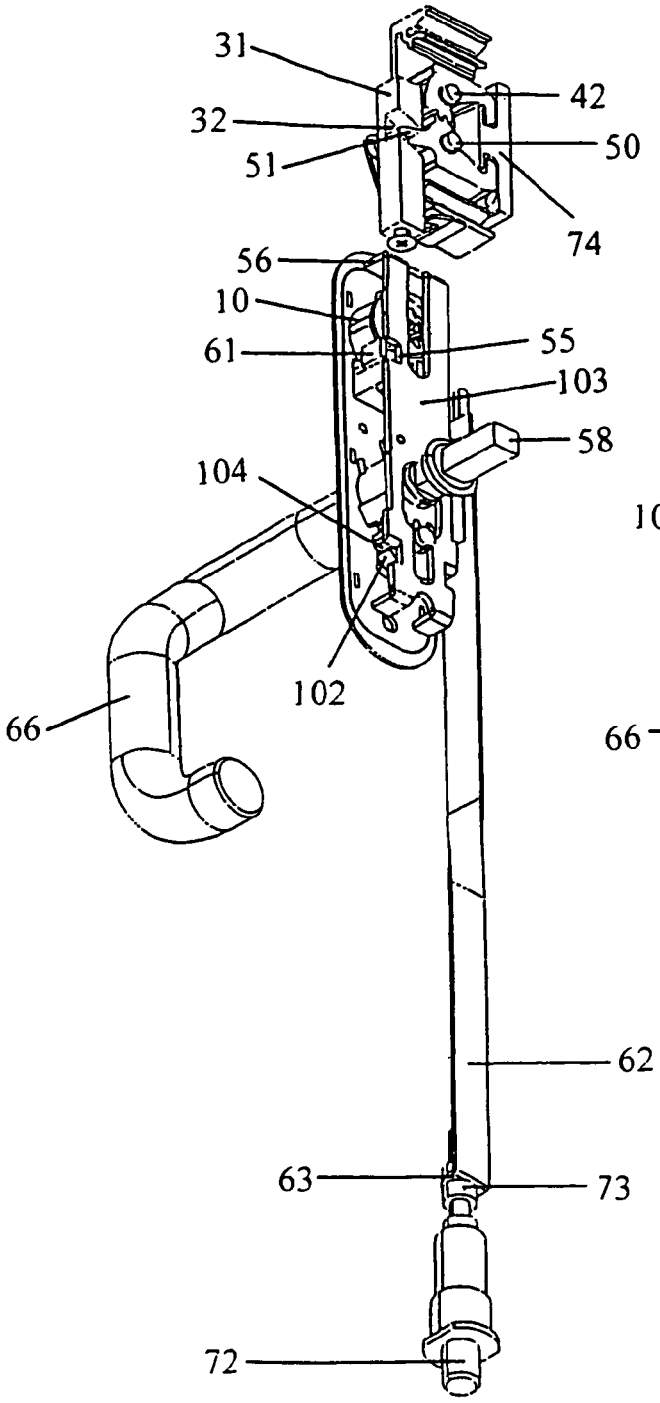
FIG. 21 is a perspective view of the rear of the latch assembly of the present invention in the latched position.
Figure 25:
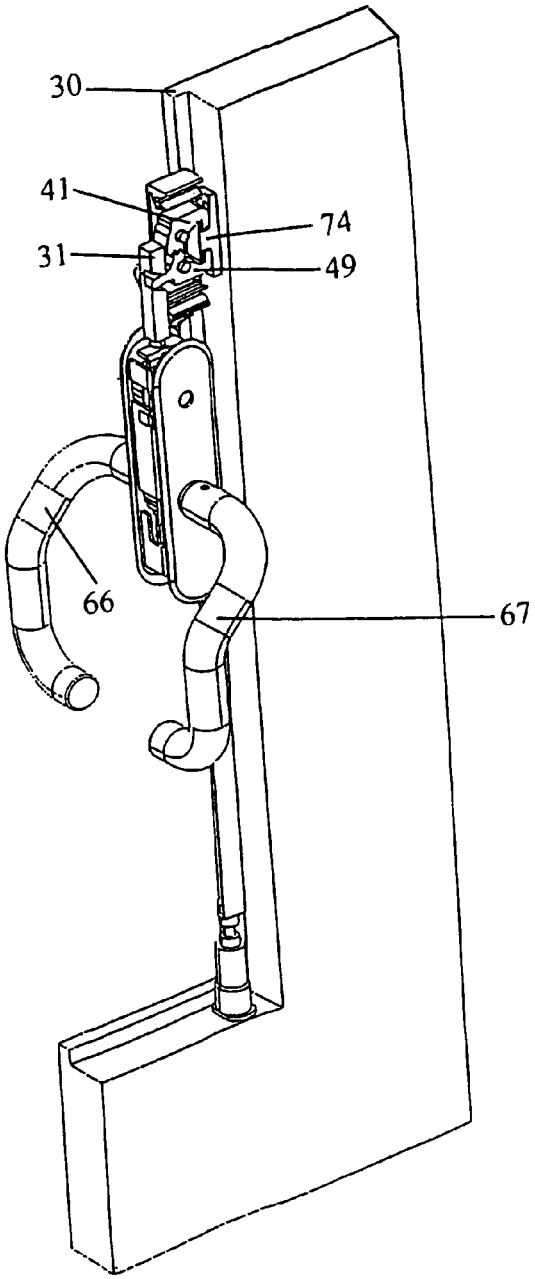
FIG. 25 is a perspective view of the rear of the latch assembly of the present invention shown latched to a keeper on a frame but with the door in which the latch is installed not shown.
Figure 24:
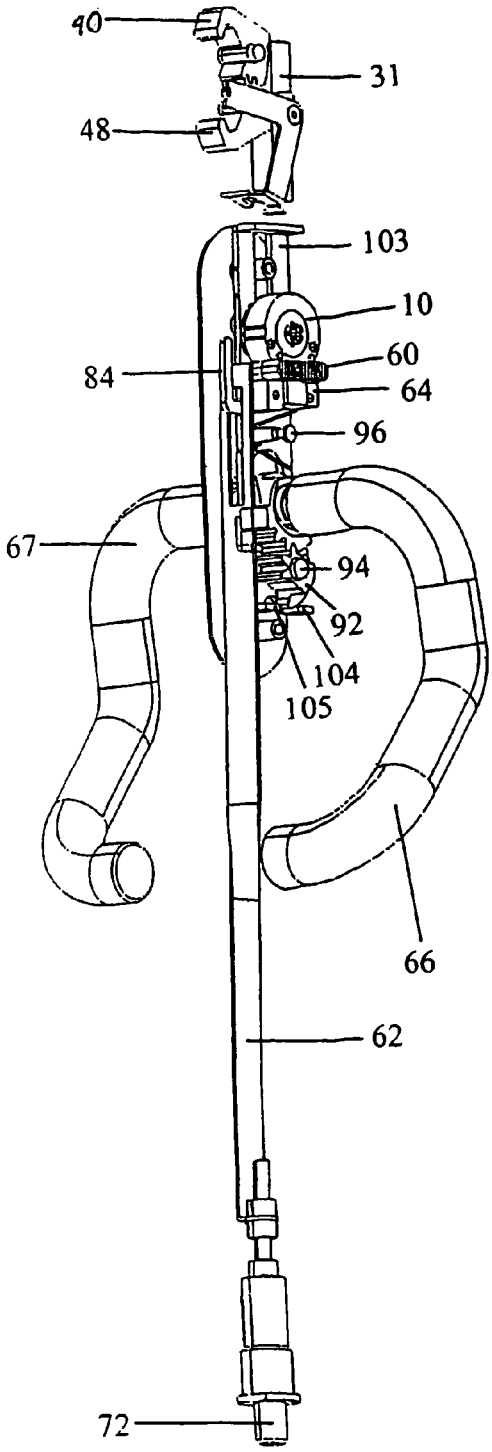
FIG. 24 is a perspective view of the front of the latch assembly of the present invention in the unlatched or open position.
Figure 26:
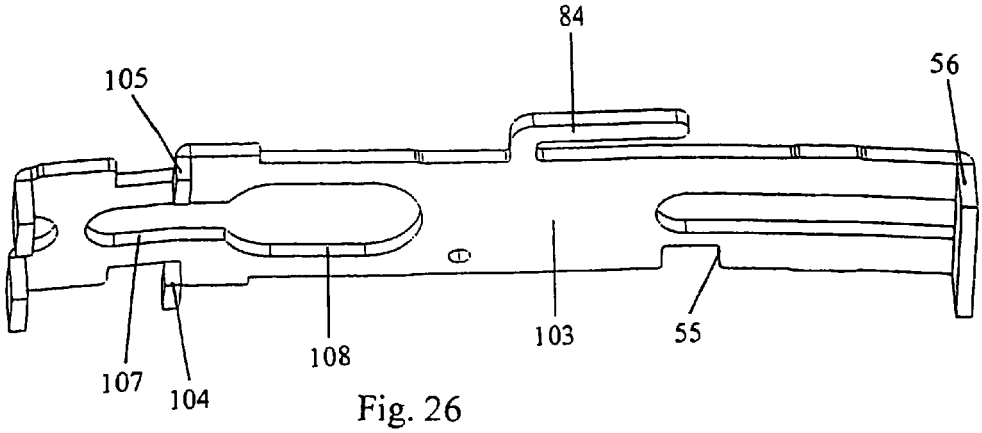
FIG. 26 is a perspective view of the sliding element of the present invention showing a hook.

The latch assembly of the first embodiment of the present invention is shown in FIGS. 16 and 25 in the latched position fastened to a keeper 74 and the slide latch assembly is shown installed in FIG. 17 in a door 29. An exploded view of the latching means of the first embodiment is shown in FIG. 19. The latching means comprises a pawl actuator 31, a first rotary pawl 41 which is rotatable about first rotary pawl pin 42. In the embodiment shown, the first rotary pawl 41 has a first rotary pawl claw 40. A second rotary pawl 49 has a lever 51 and second rotary pawl claw 48 and rotates about second rotary pawl pin 50. The first rotary pawl 41 engages by the engagement of teeth 43 and rotates the second rotary pawl 49 upon actuation of the lever 51 by the pawl actuator 31 such that the first rotary pawl 41 and the second rotary pawl 49 rotate into a latched position and engage the keeper 74 shown in FIGS. 16 and 25.

The latching means of the first embodiment also comprises a biasing means 38 which biases the pawl actuator 31 to the latched position. In the embodiment shown the biasing means is a coil spring 38 which acts upon the pawl actuator 31. The other end of the coil spring 38 presses against the bottom of the rotary latch rear cover piece 35 which can be held together with rotary latch front cover piece 39 by pins or screws which extend from rotary latch front cover piece apertures 44 to rotary latch rear cover piece apertures 36.

The pawl actuator 31 of the first embodiment can be inserted into pawl actuator groove 37 and has a notch 32 and the pawl actuator 31 has pawl actuator screw hole 34 for pawl actuator screw 33. Assembly of the rotary latch latching means can be made much easier and the coil spring 38 can be held in a compressed state more easily by the presence of latch elbow 45 which is screwed on at latch elbow connecting means (here an aperture 76) to the rotary latch rear cover piece 35 by screw 47 into a screw hole (not shown) on the rotary latch rear cover piece 35. Latch elbow yoke 46 when rotated into position around pawl actuator screw 33 can hold the pawl actuator 31 in the compressed position in order to provide for ease of assembly. Front cover piece screw holes 81 are provided for the attachment of the latching means to a frame by a screw (not shown).

Figure 30:
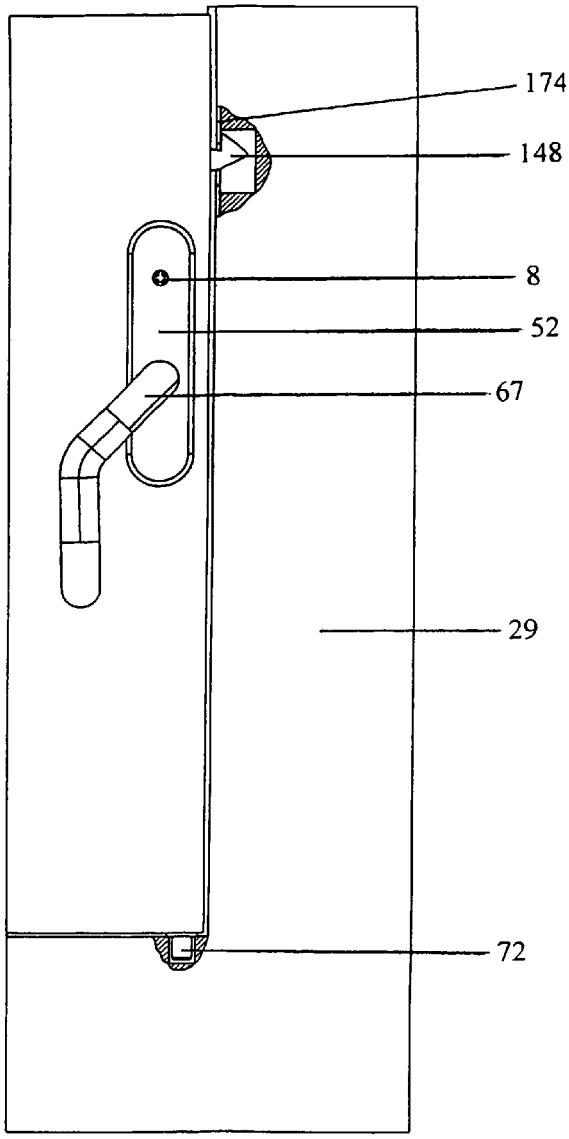
FIG. 30 is a side view of a second embodiment of the latch assembly of the present invention in the latched position showing partially cutaway in section a latching means having a single pawl.
Figure 31:
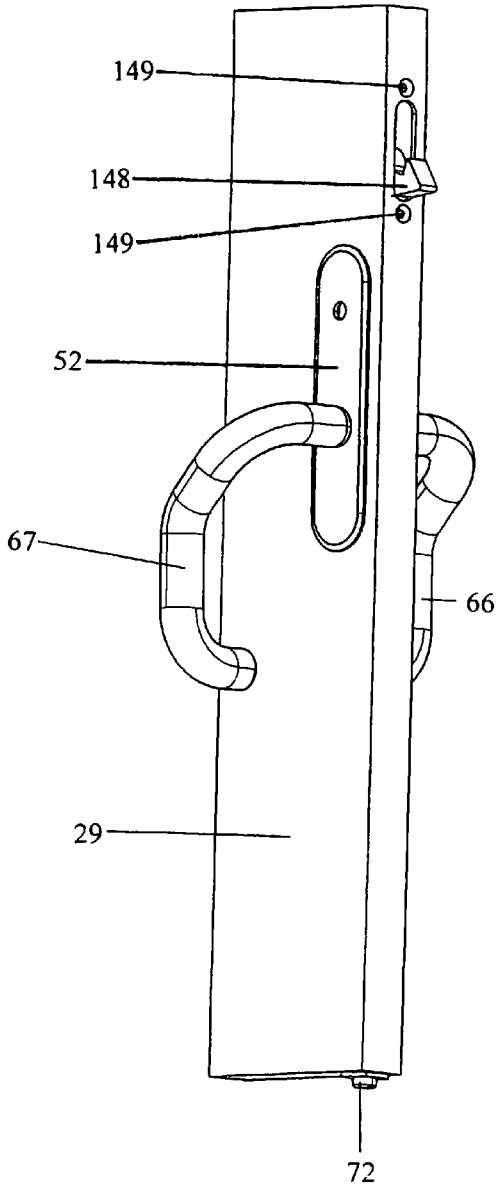
FIG. 31 is a perspective view of the second embodiment of the latch assembly of the present invention in the open or unlatched position.
Figure 32:
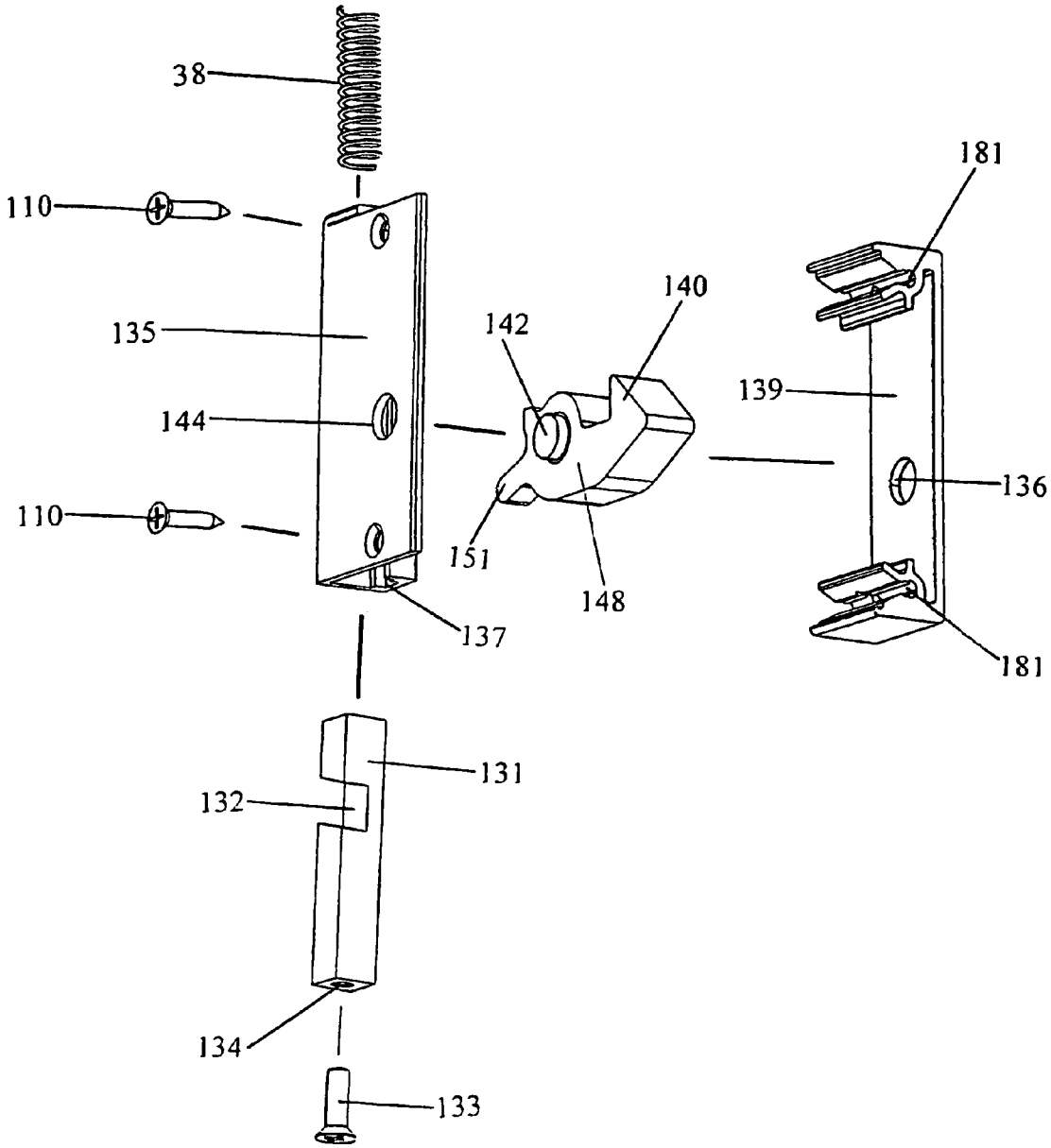
FIG. 32 is an exploded view of the latching means of the second embodiment of the present invention showing a single pawl.
Figure 33:
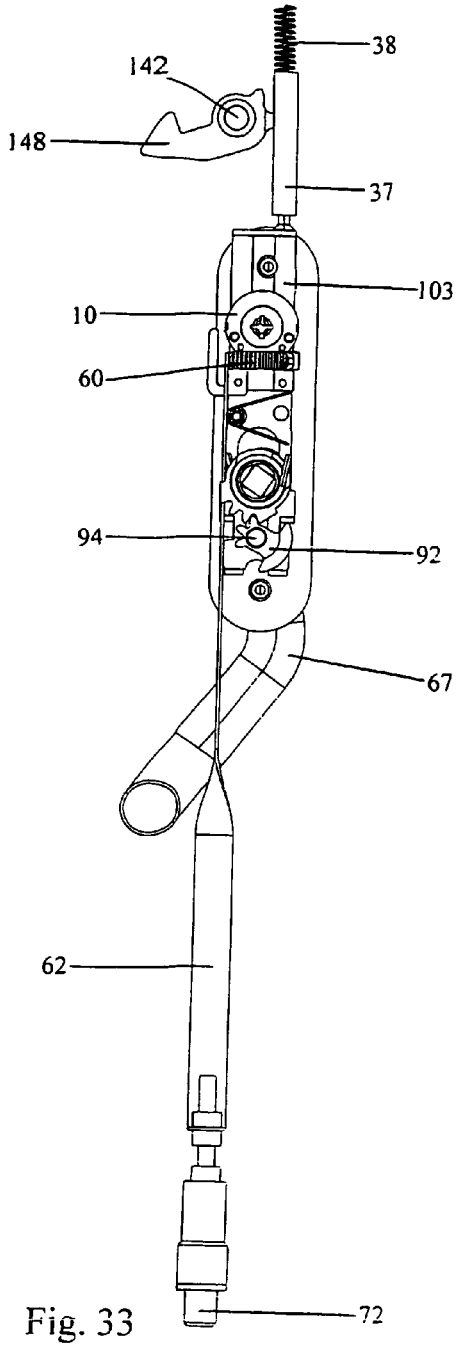
FIG. 33 is a side view of the front of the second embodiment of the present invention shown with the actuator base plate, actuator frame and single pawl front and rear cover pieces removed.
Figure 34:
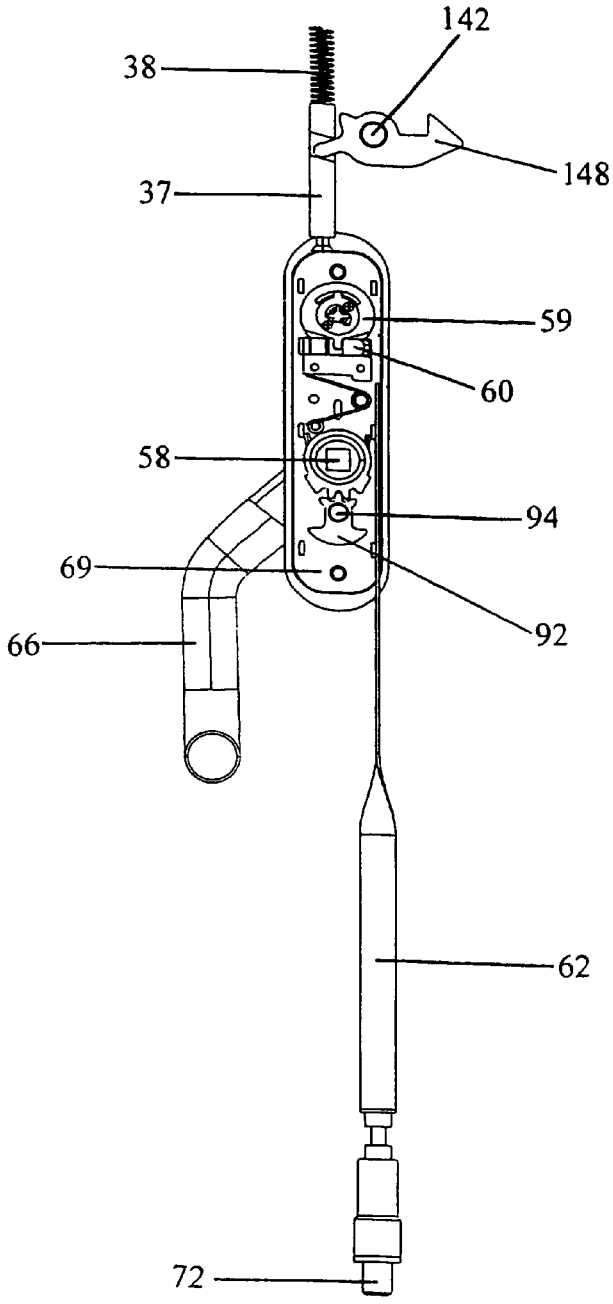
FIG. 34 is a side view of the rear of the second embodiment of the present invention shown with the actuator frame removed.

The latch assembly of the second embodiment of the present invention is shown in FIGS. 30 and 34 in the latched position fastened to a keeper 174 and the slide latch assembly is shown installed in FIG. 31 in a door 29. An exploded view of the latching means is shown in FIG. 32. The latching means comprises a single pawl actuator 131 and a single pawl 148 which is rotatable about single pawl pin 142. In the embodiment shown, the single pawl 148 has a single pawl claw 140. The single pawl 148 upon actuation of lever 151 by the single pawl actuator 131 rotates such that the single pawl 148 moves to a latched position and engages the keeper 174 shown in FIG. 30.

The latching means also comprises a biasing means 38 which biases the single pawl actuator 131 to the latched position. In the embodiment shown the biasing means is a coil spring 38 which acts upon the single pawl actuator 131. In the embodiment shown, the coil spring acts upon a face of the single pawl actuator. The other end of the coil spring 38 presses against the bottom of the single pawl rear cover piece 135 which can be held together with single pawl front cover piece 139 by pins or screws 110 which extend from rotary latch front cover piece apertures 144 to rotary latch rear cover piece apertures 136. Screws 149 as seen in FIG. 31 can affix the single pawl latching means to a door 29.

The single pawl actuator 131 can be inserted into pawl actuator groove 137 and has a notch 132 and the single pawl actuator 131 has pawl actuator screw hole 134 for single pawl actuator screw 133.

Figure 18:
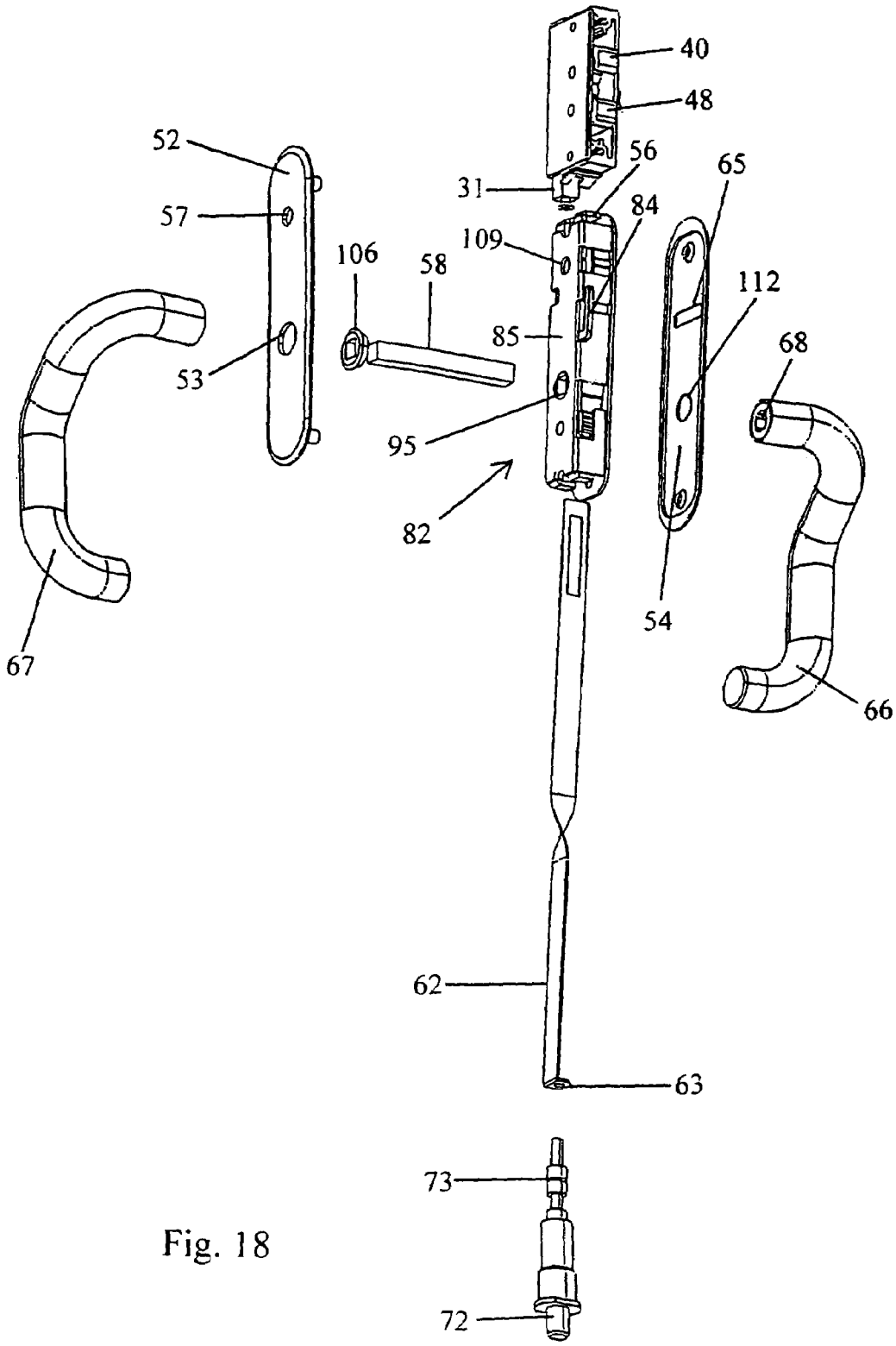
FIG. 18 is an exploded view of the latch assembly of the present invention in the latched position.

Operation of the actuator for either of the two embodiments of the present invention is made by way of reference to the first embodiment of the invention as described below. As shown in FIG. 18, actuator 82 which can be provided in either the first or second embodiment of the invention has sliding element actuator 56 for displacing the pawl actuator 31 when the sliding element actuator is urged toward the pawl actuator 31. At least one handle such as the front handle 66 or the rear handle 67 is provided on actuator bar 58 for actuating by rotation of the actuator bar insert 95 for providing a sliding motion to the sliding element 103 such that the sliding element actuator 56 actuates latching means. As seen in FIG. 20-24, rotation of either of the handles rotates a first actuator rotation means 90 which in turn rotates a second actuator rotation means 92 which has camlike protuberances which are right protuberance 102 or left protuberance 101 which act upon right sliding element prong 104 and left slide element prong 105. This action upon a left sliding element prong 104 or a right sliding element prong 105 moves the sliding element 103 such that the sliding element actuates the latching means.

Actuator rear cover plate 52 which has actuator rear cover plate aperture 57 can be mounted on the rear side of a closure member such as a door 29 or a panel and a user of the latch assembly could then insert a key in actuator rear cover plate key aperture 53 and unlock the latch assembly and then pull the rear handle 67 in this preferred embodiment in either the clockwise or counterclockwise direction to open the latch assembly. As seen in FIG. 18, actuator front cover plate 54 is provided which has actuator front cover plate aperture 112 for actuator bar 58 and actuator bar ring 106.

When the actuator 82 is actuated, rod 62 which is attached to hook 84 on slide element 103 drives plunger 72 which is connected at the plunger connecting means 73 to the rod 62 at rod flange 63.

As seen in FIGS. 26-29, the actuator 82 is formed by actuator base plate 69 having base plate actuator bar aperture 71, base plate toggle button aperture 70, and slots 100 which are provided for being fit for each foot 99 of actuator frame 85 which also features an actuator frame bar aperture 88. Hook guide means 86 and hook stop 87 are provided on the actuator frame 85 to guide hook 84 as it is displaced. Hook stop 87 establishes the limit of movement of hook 84 in one direction. Guide side piece 97 and middle actuator side piece 98 provide the desired depth of the actuator frame 85.

Second actuator rotation means 92 mounted on second actuator rotation means pin 94 has a plurality of teeth such as tooth 93 which engages teeth such as tooth 93 of first actuator rotation means 90 which has actuator bar insert 95 so as to provide for engagement of the actuator bar 58. As should be readily apparent from FIGS. 20 and 22, the engagement of the teeth of the second actuator rotation means 92 with the teeth of the first actuator rotation means 90, as described, results in the second actuator rotation means 92 rotating in a direction opposite the direction of rotation of the first actuator rotation means 90 as the first actuator rotation means 90 is rotated.

Biasing means 91 which is preferably a coil spring located in a channel in first rotary means 90 biases the handle of the latch assembly such that when a user turns the handle either in the clockwise or the counterclockwise direction, the handle is biased to the relaxed position in which the latching means is closed and the plunger 72 is withdrawn in the direction of the actuator. Plunger 72 is shown in FIG. 16 engaged with second keeper means 111.

Actuator spring 75 which is mounted on actuator spring pin 96, provides resistance against a user from moving the sliding element 103 in the direction of the latching means.

In order to provide for reliable operation of the sliding element 103, the sliding element is provided with second guide means 107 and first guide means 108 for providing for guiding of the movement of the second actuator rotation means 92 and first actuator rotation means 90, respectively.

Figure 1:
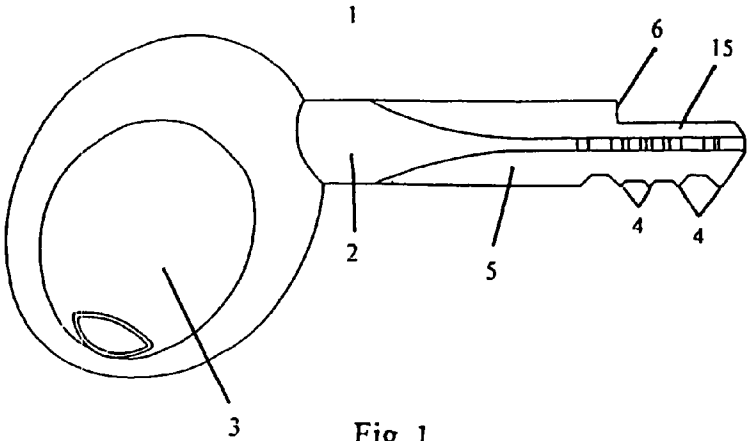
FIG. 1 is a side elevational view of the low level security key for use with the present invention.
Figure 3:
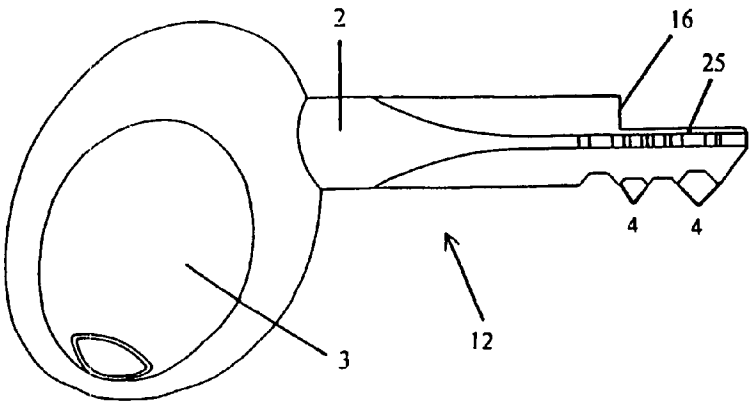
FIG. 3 is a side elevational view of the master key for use with the present invention.
Figure 23:
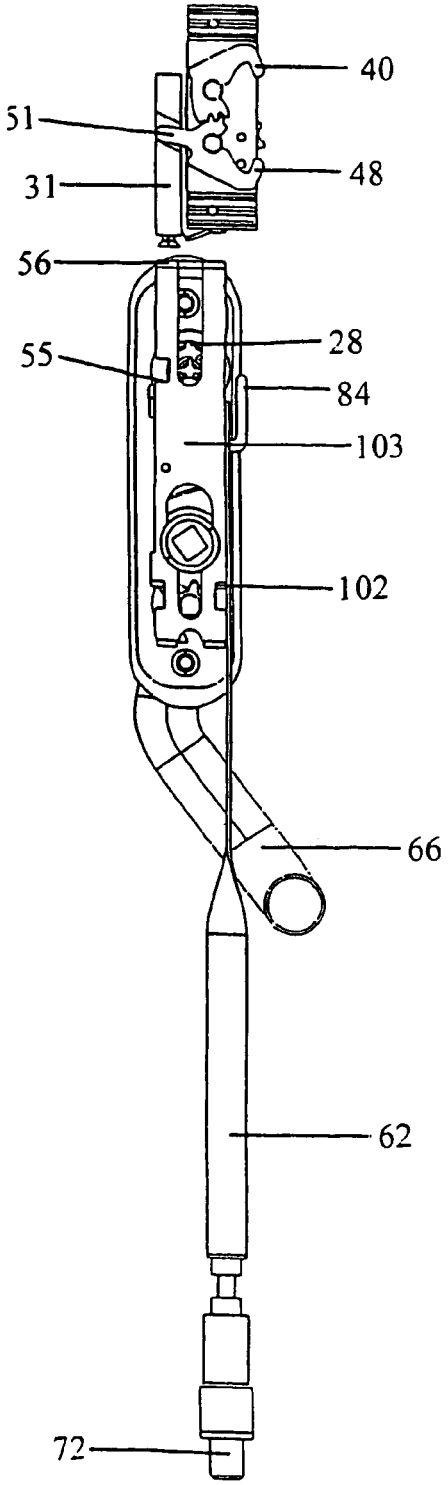
FIG. 23 is a side view of the rear of the latch assembly of the present invention in the unlatched or open position.
Figure 22:
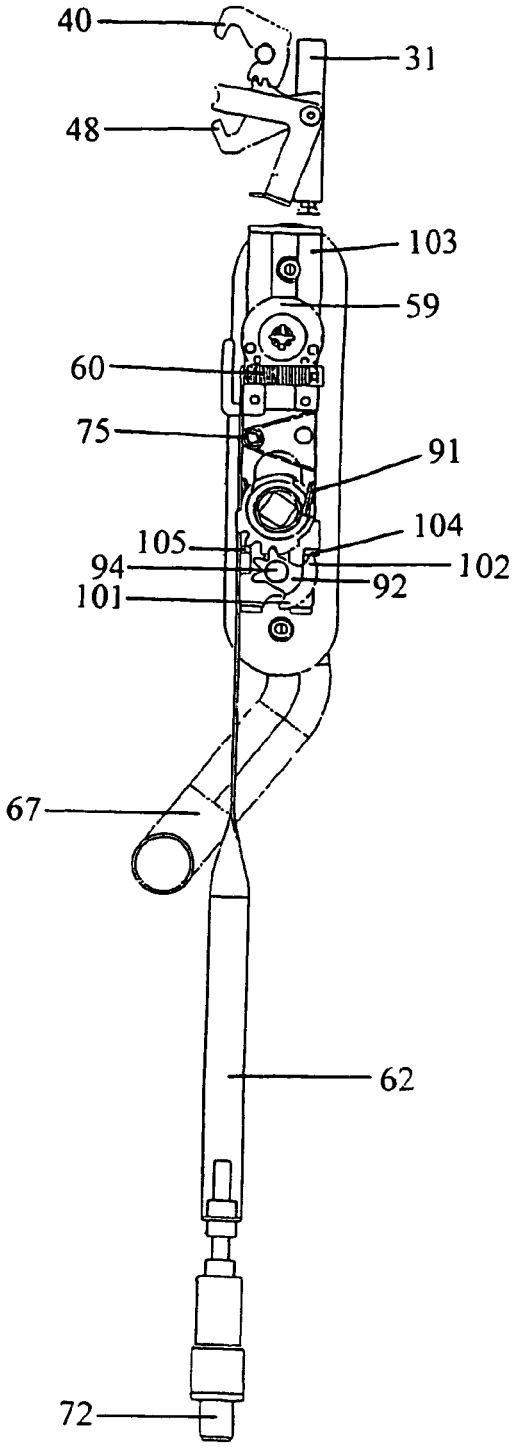
FIG. 22 is a side view of the front of the latch assembly of the present invention in the unlatched or open position.

The slide latch assembly can be locked and unlocked in two different ways: by either the use of a key, most preferably by low level security key 1 or master key 12 as shown in FIGS. 1 and 3 or by the operation of toggle button 60 on the locking mechanism shown in FIG. 23.

The toggle button 60 has a toggle button protuberance 61. The toggle button 60 is capable of moving the toggle button protuberance 61 such that the toggle button protuberance 61 engages the sliding element notch 55 thereby placing the latch assembly into a locked state in which movement of the sliding element 103 is not permitted. The toggle button 60 is also moveable by, in the preferred embodiment shown, the rotation of the toggle button 60 about mounting block protuberance 83 such that the toggle button protuberance 61 does not engage the sliding element notch 55 thereby placing the latch assembly in the unlocked state in which displacement of the sliding element 103 is permitted. Toggle button 60 is mounted by way of toggle button aperture 79 on mounting block protuberance 83 which is on mounting block 64.

Figure 11:
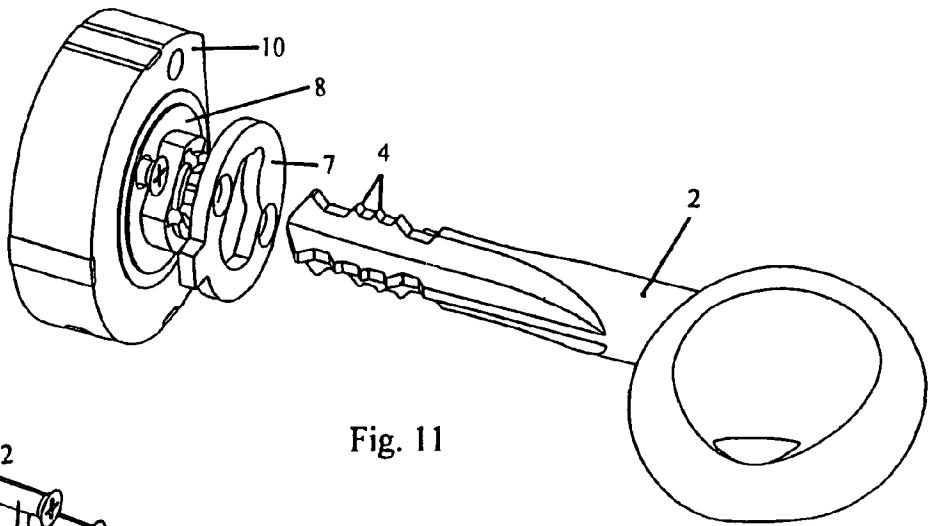
FIG. 11 is an exploded view of the lock cylinder and low level security key for use with one embodiment of the present invention in a locked state shown with a low level security annular ring.
Figure 20:
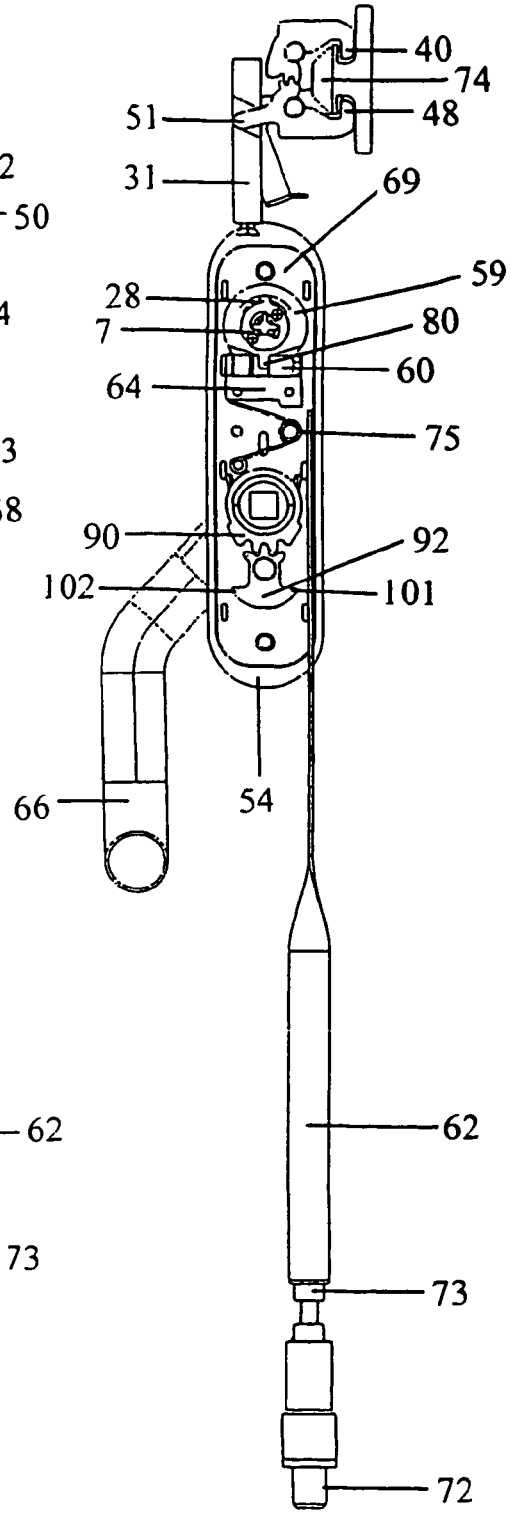
FIG. 20 is a side view of the rear of the latch assembly of the present invention in the latched position.
Figure 27:
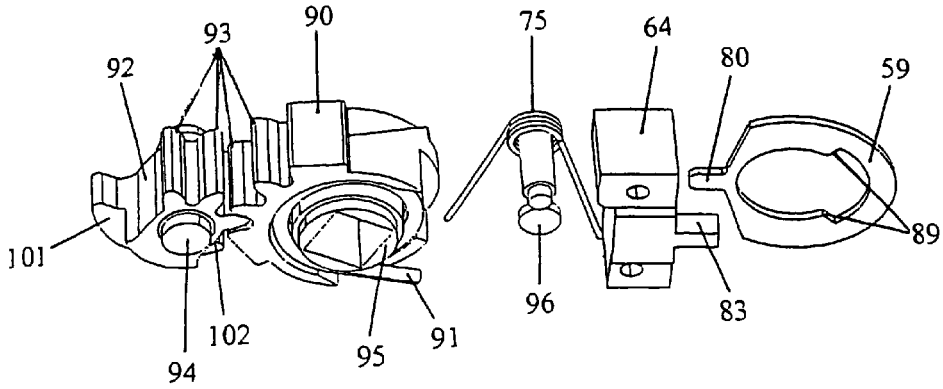
FIG. 27 is a perspective view of a portion of the actuator of the present invention.
Figure 28:
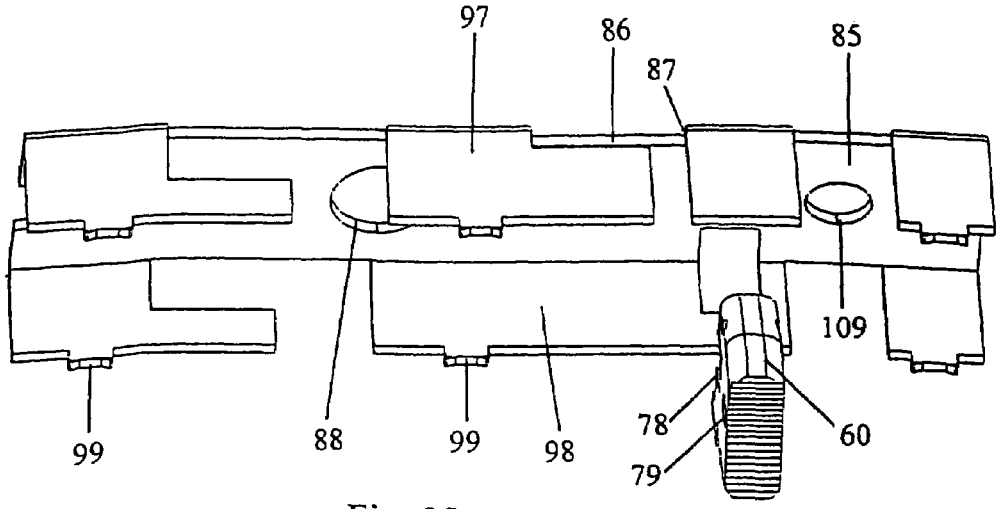
FIG. 28 is an exploded view of the actuator frame and toggle button.
Figure 29:
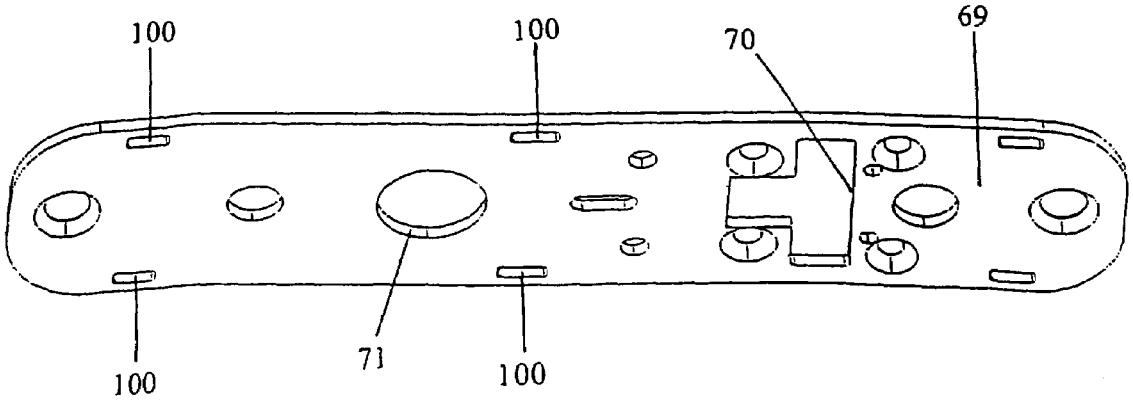
FIG. 29 is a front view of the actuator base plate of the present invention.

In the embodiment shown in FIGS. 20, 27 and FIG. 11, the lock cylinder 13 has a lock plug 8 which rotates annular ring 7 which, in turn, rotates a locking ring 59 having a locking ring protuberance 80. When a user rotates a key for lockplug 8, selective placement of the latch assembly into the locked state or the unlocked state is provided for upon rotation of a lock plug 8 by the engagement of the locking ring protuberance 80 with the inner sides of toggle button notch 78 of toggle button 60 in FIG. 28.

The lock plug 8 can be provided for access by the low level security key 1 or the master key 12 as described in detail below.

The above described invention permits a user to rotate front handle 66 or rear handle 67 and actuate the actuator in the direction of the pawl actuator 31 and allows the user to latch a door or panel in which the latch assembly is installed to a keeper.

In a preferred embodiment of the present invention, the latch assembly is adapted for use with a low level security key and/or a master key.

Figure 5:
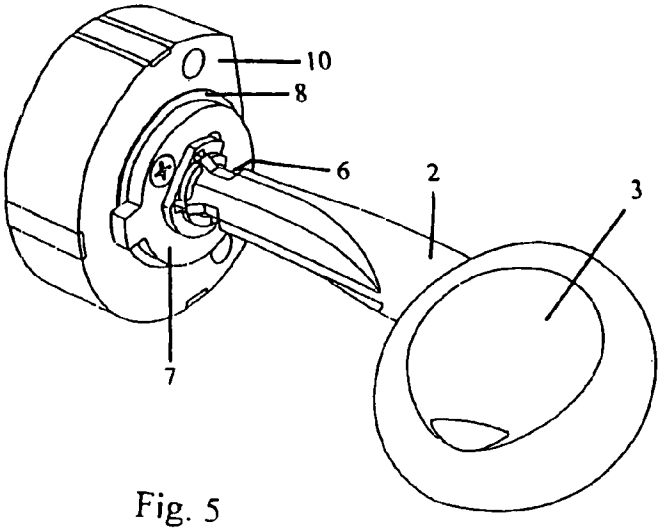
FIG. 5 is a perspective view of the lock cylinder and low level security key for use with the present invention in a locked state shown with a low level security annular ring.
Figure 7:
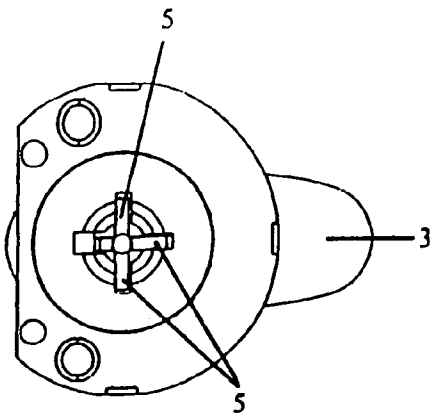
FIG. 7 is a rear elevational view of the lock cylinder and low level security key for use with the present invention in a locked state shown with a low level security annular ring.
Figure 9:
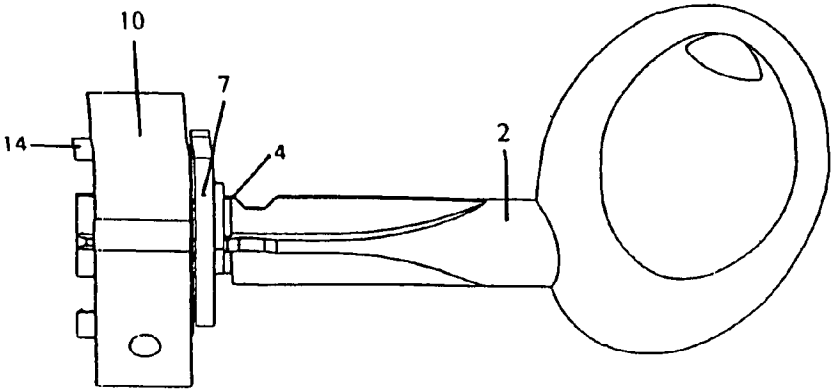
FIG. 9 is a side elevational view of the lock cylinder and low level security key for use with the present invention in an unlocked state shown with a low level security annular ring.

As seen in FIG. 1, low level security key 1 has grip portion 3 to be held by a user of the low level security key 1 and a stem 2 extending from the grip portion 3. Individual bittings 4 are formed on at least one of the bits of the low level security key 1. Stem 2 of the key 1 which is preferably cylindrical in cross section extends from the grip portion 3 to the bits of the low level security key 1. As shown in this embodiment the low level security key 1, one end of the low level security key 1 is in a star profile as seen in FIG. 7 and has three bitted bits 5. The fourth bit which forms part of the remaining portion of the star profile is the low level security key stop bit 15 which terminates in a low level security key stop 6. Low level security key 1 is dimensioned and configured to be inserted into lock cylinder 13 which has low level security annular ring 7 as seen in FIG. 5 until low level security key stop 6 contacts low level security annular ring 7 which thereby prevents further insertion of low level security key 1 into lock plug 8.

The low level security key stop 6 has a depth equal to the difference between the distance from the top of the low level security key stop bit 15 to the axis of low level security key 1 and the distance from the top of the low level security key stop 6 to the axis of the low level security key, wherein the depth of the low level security key stop 6 is less than the depth of the master key stop 16.

Figure 6:
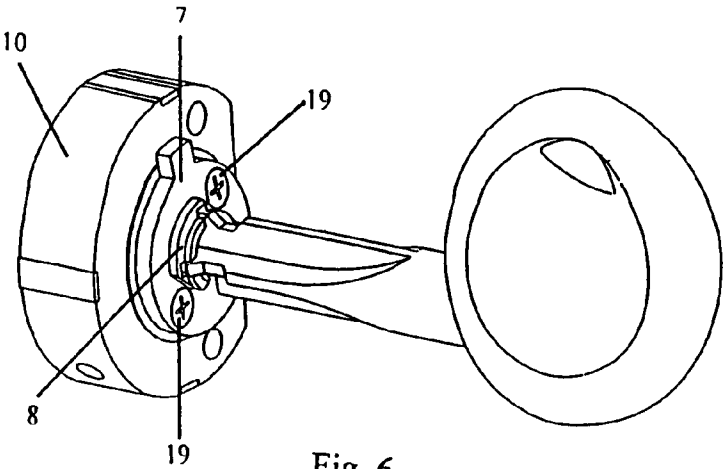
FIG. 6 is a perspective view of the lock cylinder and low level security key for use with the present invention in an unlocked state shown with a low level security annular ring.
Figure 8:
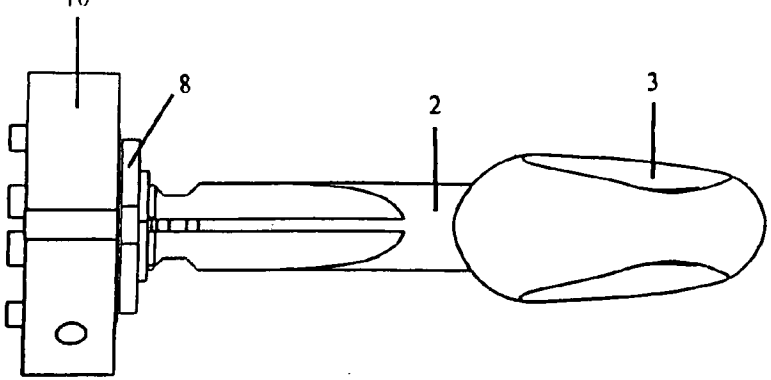
FIG. 8 is a side elevational view of the lock cylinder and low level security key for use with the present invention in a locked state shown with a low level security annular ring.

When the lower level security key 1 or master key 12 is inserted, one or more of the bitted bits 5 engage tumblers (not shown) in the lock plug 8 and lock shell 10 which in the locked state extend from lock plug apertures 24 in the lock plug 8 into corresponding lock shell apertures 24 in lock shell 10. After insertion of the low level security key 1, the bitted bits 5 push and align the tumblers which are preferably biased by a biasing means such as a coil spring into positions such that none of the tumblers contacts simultaneously both the lock plug 8 and the lock shell 10 thereby permitting rotation of the lock shell 10 relative to lock plug 8. A user then turns grip portion 3 of the low level security key 1 in a clockwise direction as seen in FIG. 6 to unlock the lock plug 8 from the lock shell 10.

Figure 2:
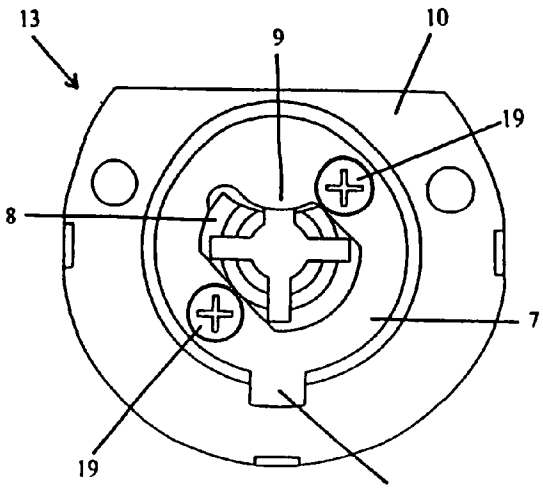
FIG. 2 is a front elevational view of the lock cylinder for use with the present invention having a low level security annular ring.

Lock cylinder 13 of FIG. 2 which is shown with low level security annular ring 7 also accommodates master key 12 of FIG. 3 as the depth of master key stop 16 is sufficiently deep as measured from the top of the master key stop 16 to the top of the master key stop bit 25 to permit passage of the master key 12 into the lock plug 8 until master key stop 16 is prevented from being inserted further into the lock plug 8 by contact with ring stop 9 on low level annular ring 7. The master key stop 16 has a depth equal to the difference between the distance from the top of the master key stop bit 25 to the axis of the master key 12 and the distance from the top of the master key stop 16 to the axis of the master key 12. Therefore, lock cylinder 13 when provided with the low level annular ring 7 can be operated with either the master key 12 or low level security key 1.

Figure 4:
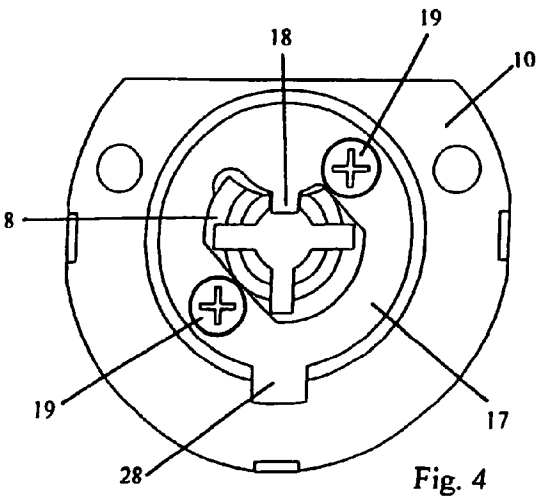
FIG. 4 is a front elevational view of the lock cylinder for use with the present invention having a master annular ring.

In FIG. 4, the same lock plug 8 and lock shell 10 as seen in FIG. 2 is provided, however a master annular ring 17 is shown screwed to the front of the lock plug 8 by screws 19. The master annular ring 17 is different from the low level annular ring 7 of FIG. 2 in that the master annular ring 17 has a tab 18 which prevents insertion of low level security key 1 into lock plug 8. The low level security key 1 is prevented from being inserted into the lock plug 8 by the contact of low level key stop 6 against tab 18. On the other hand, master key 12 can be inserted into lock plug 8 in FIG. 4 because of the greater depth of master key stop 16 which permits passage of the master key stop bit 25 below tab 18. Accordingly, master key 12 can function as a master key which has the capability of opening both the lock cylinder 13 when it is provided with a low level security annular ring 7 and the lock cylinder 13 when it is provided with a master annular ring 17.

In the same way if a user were to try to insert the low level security key 1 in the lock cylinder 13 while the lock cylinder 13 is fitted with a master annular ring, the bit 15 would be blocked from entering the lock cylinder 13 by tab 18 on the master annular ring 17.

Figure 10:
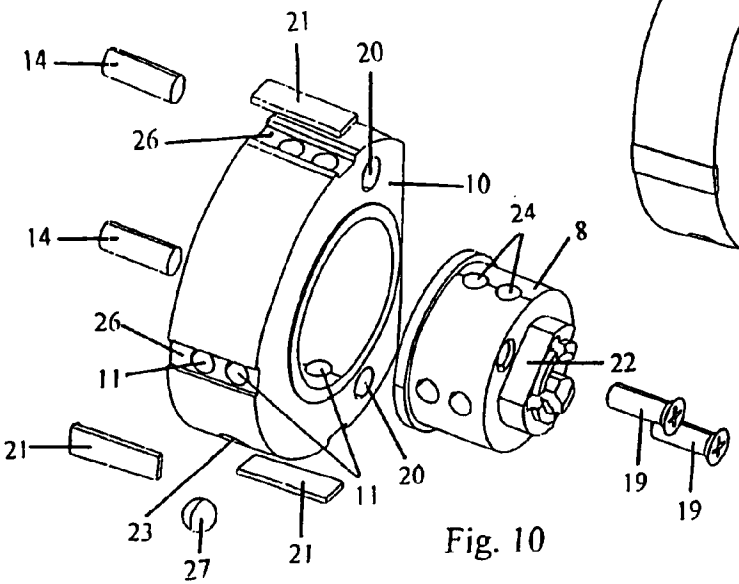
FIG. 10 is an exploded view of the lock cylinder for use with the present invention without either a master annular ring or a low level security annular ring.

FIGS. 10 and 11 show an exploded view of the lock cylinder 13 of the present invention having shell 10 and lock plug 8. In order to provide for mounting of the lock cylinder 13 in a latch, prongs 14 are provided mounted in an apertures 20 in the lock shell 10. Also, the lock shell 10 is provided with grooves in which plates 21 are fitted to keep biasing means, i.e. coil springs, and tumblers in the lock shell 10 and lock plug 8. Lock plug 8 is also fitted with ring support 22 which serves to maintain the relative position of either the master annular ring 17 or the low level security annular ring 7. In a preferred embodiment, the lock shell 10 is fitted with a ball bearing aperture 23 in which ball bearing 27 is located together with a biasing means (not shown) such as a coil spring. The ball bearing 27 in the ball bearing aperture 23 is biased toward the lock plug 8 which has a detent (not shown) in which a portion of the ball bearing 27 will rest when the lock plug 8 is properly aligned with lock shell 10.

Preferably, the lock plug 8 is located concentric to and rotatable inside of and relative to said lock shell 10, and said lock plug 8 is configured for insertion of said master key 12 or said low level security key 1.

Figure 13:
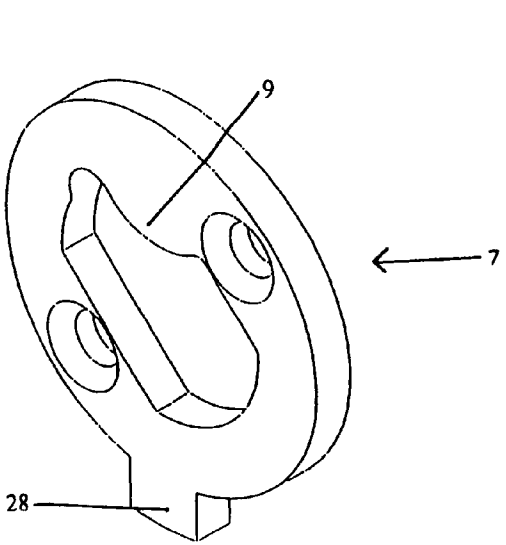
FIG. 13 is a perspective view of the low level security annular ring for use with one embodiment of the lock cylinder of the present invention.
Figure 15:
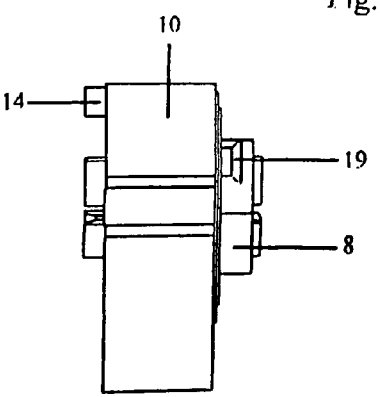
FIG. 15 is a side view of the lock cylinder for use with one embodiment of the present invention shown without a low level security annular ring or a master annular ring.
Figure 12:
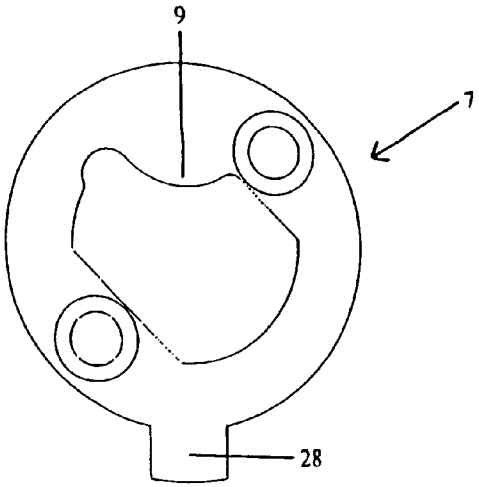
FIG. 12 is a top plan view of the low level security annular ring for use with one embodiment of the lock cylinder of the present invention.
Figure 14:
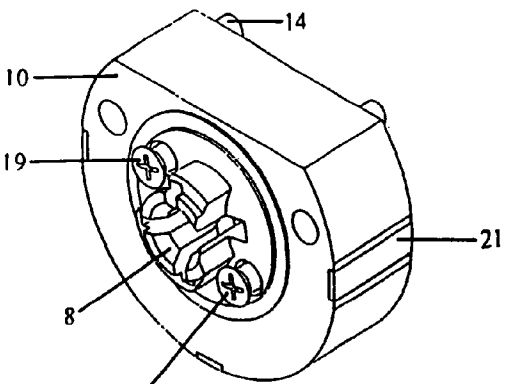
FIG. 14 is a perspective view of the lock cylinder for use with one embodiment of the present invention shown without a low level security annular ring or a master annular ring.

Low level security annular ring 7 as shown in FIGS. 12 and 13 has a ring stop 9 which contacts key stop 6 when the low level security key 1 is used and which contacts master key stop 16 when the master key 12 is used. The ring stop 9 can be of any shape which permits insertion of the master key 12 and the low level security key 1 into the lock plug 8 but acts as a stop against a portion of the master key stop 16 or low level security key stop 6 respectively. The tab 18 of the master annular ring 17 can be of any shape, thickness or configuration which permits insertion of the master key 12 up to the master key stop 16 but which does not permit insertion of the low level security key 1 due to contact of the low level security key stop bit 15 against the tab 18.

Tab 18 extends into an interior portion of the ring formed by the master annular ring 17 and the tab 18 permits insertion of the master key stop bit 25 into the lock plug 8 until the master key stop 16 contacts the tab 18 on the master annular ring 17.

Actuator 28 on master annular ring 17 or low level annular ring 7 which are both preferably in the form of a ring actuate the means by which the latch or lock in which the lock cylinder 13 is unlocked when a user unlocks the lock cylinder 13 and rotates either the master key 12 or low level security key 1.

As can be seen by a comparison of FIG. 1 and FIG. 3, a master key and a low level security key can preferably be provided which can have identical bittings on the bits of the two keys. However, when the basic lock cylinder configuration of a lock plug and lock shell is provided with a master annular ring then only the master key can open the lock cylinder. However, the lock cylinder can be opened by a low level security key or master key when the lock cylinder is fitted with the low level security annular ring.

Many changes can be made in the above-described invention without departing from the intent and scope thereof. It is therefore intended that the above description be read in the illustrative sense and not in the limiting sense. Substitutions and changes can be made without departing from the scope and intent of the invention.

We claim:

1. An actuator for actuating a latching means in a latch assembly for fastening a closure member to a keeper in a latched position, the latch assembly being moveable between the latched position and an open position, the actuator comprising:

an actuating means for actuating the actuator upon clockwise or counterclockwise rotation of the actuating means from a relaxed position;

a biasing means for biasing said actuating means toward the relaxed position;

a first actuator rotation means rotatable by the actuating means in the clockwise or counterclockwise direction, which define a direction of rotation of the first actuator rotation means;

a second actuator rotation means having at least one protuberance, said second actuator rotation means rotating in a direction opposite to the direction of rotation of the first actuator rotation means by engagement with the first actuator rotation means, as the first actuator rotation means is rotated;

a sliding element slidingly displaceable relative to the actuator, the sliding element having at least one sliding element prong;

wherein rotation of the actuating means in the clockwise direction rotates said second actuator rotation means such that said at least one protuberance acts upon said at least one sliding element prong and said sliding element slides relative to the actuator to actuate the latching means moving the latch assembly to the open position and rotation of the actuating means in the counterclockwise direction rotates said second actuator rotation means such that said at least one protuberance acts upon said at least one sliding element prong and said sliding element slides relative to the actuator to actuate the latching means moving the latch assembly to the open position.

2. The actuator of claim 1 further comprising a second biasing means for biasing said sliding element away from said latching means.

3. The actuator of claim 1 further comprising an actuator frame, said sliding element being slidable in said actuator frame.

4. The actuator of claim 1 further comprising an actuator handle connected to the actuating means for rotating of the actuating means by rotation of the actuator handle.

5. The actuator of claim 1 in combination with a connecting means connected to the sliding element and a plunger means connected to the connecting means for engagement with a second keeper.

6. The actuator of claim 1 further comprising a locking means for locking said actuator, the locking means having a locking means protuberance and the locking means being moveable between a locked position in which the locking means protuberance engages the sliding element and prevents movement of the sliding element and an unlocked position in which said locking means protuberance does not engage said sliding element.

7. The actuator of claim 6 further comprising a lock cylinder, said lock cylinder having a locking ring having a locking ring protuberance, said locking ring being engageable with the locking means such that rotation of the locking ring pivots the locking means between the locked state and the unlocked state upon rotation of the locking ring by the engagement of the locking ring protuberance with the locking means.

8. A latch assembly comprising a latching means for fastening to keeper in a latched position and an actuator for actuating means, the latching means being moveable between the latched position and an open position, wherein the latching means comprises:

a single pawl, the single pawl being rotatable in the latching means, the single pawl having a lever and a pawl for engaging a keeper when the latching means is in the latched position;

a single pawl actuator displaceable in the latching means, the single pawl actuator having an engagement means for engaging the lever of the single pawl;

a first biasing means acting against the single pawl actuator for biasing the single pawl actuator toward the latched position;

wherein displacement of the single pawl actuator in the latching means against the first biasing means rotates the single pawl into the open position; and wherein the actuator comprises:

an actuating means for actuating the actuator upon clockwise or counterclockwise rotation of the actuating means from a relaxed position;

a second biasing means for biasing said actuating means toward the relaxed position;

a first actuator rotation means rotatable by the actuating means in the clockwise or counterclockwise direction, which define a direction of rotation of the first actuator rotation means;

a second actuator rotation means having at least one protuberance, said second actuator rotation means rotating in a direction opposite to the direction of rotation of the first actuator rotation means by engagement with the first actuator rotation means, as the first actuator rotation means is rotated;

a sliding element slidingly displaceable relative to the actuator, the sliding element having at least one sliding element prong, wherein rotation of the actuating means in the clockwise direction rotates said second actuator rotation means such that said at least one protuberance acts upon said at least one sliding element prong and said sliding element slides relative to the actuator to actuate the latching means moving the latch assembly to the open position and rotation of the actuating means in the counterclockwise direction rotates said second actuator rotation means such that said at least one protuberance acts upon said at least one sliding element prong and said sliding element slides relative to the actuator to actuate the latching means moving the latch assembly to the open position.

9. The latching means of claim 8 wherein the biasing means is a coil spring.

10. A latch assembly comprising a latching means for fastening to a keeper in a latched position and an actuator for actuating the latching means, the latching means being moveable between the latched position and an open position, wherein the latching means comprises:

a first pawl, the first pawl being rotatable in the latching means, the first pawl having a claw for engaging the keeper when the latching means is in the latched position;

a second pawl, the second pawl being rotatable in the latching means, the second pawl having a lever, a claw for engaging the keeper when the latching means is in the latched position, and first pawl engaging means, said first pawl being rotatable by engagement of the first pawl with the first pawl engaging means of the second pawl;

a pawl actuator displaceable in the latching means, the pawl actuator having an engagement means for engaging the lever of the second pawl;

a first biasing means acting against the pawl actuator for biasing the pawl actuator toward the latched position;

wherein displacement of the pawl actuator in the latching means against the biasing means rotates the first pawl and second pawl into the open position, and wherein the actuator comprises:

an actuating means for actuating the actuator upon clockwise or counterclockwise rotation of the actuating means from a relaxed position;

an actuator biasing means for biasing said actuating means toward the relaxed position;

a first actuator rotation means rotatable by the actuating means in the clockwise or counterclockwise direction, which define a direction of rotation of the first actuator rotation means;

a second actuator rotation means having at least one protuberance, said second actuator rotation means rotating in a direction opposite to the direction of rotation of the first actuator rotation means by engagement with the first actuator rotation means, as the first actuator rotation means is rotated;

a sliding element slidingly displaceable relative to the actuator, the sliding element having at least one sliding element prong;

whereby rotation of the actuating means rotates said second actuator rotation means such that said at least one protuberance acts upon said at least one sliding element prong and said sliding element slides relative to the actuator to actuate the latching means.

11. The latching means according to claim 8 wherein the first biasing means is a coil spring.

12. The latch assembly of claim 9, wherein the latching means further comprises a latch elbow having two arms and a pivoting means for pivoting of the latch elbow between a released position and an engaged position in which one of the arms engages with an end of the pawl actuator, each of said two arms of the latch elbow extending from a pivot point of the pivoting means.

* * * * *

UNITED STATES PATENT AND TRADEMARK OFFICE

CERTIFICATE OF CORRECTION

PATENT NO. : 7,334,438 B2
APPLICATION NO. : 11/108296
DATED : February 26, 2008
INVENTOR(S) : Torsten Johansson et al.

It is certified that error appears in the above-identified patent and that said Letters Patent is hereby corrected as shown below:

Column 12, line 28, delete “8” and insert -- 10 --.

Column 12, line 30, delete “9” and insert -- 11 --.

In claim 11, column 12, line 28, after the word “latching” and before the word “according”, delete “means” and replace with the word -- assembly --.

Signed and Sealed this

Seventeenth Day of June, 2008

JON W. DUDAS
*Director of the United States Patent and Trademark Office*